US005649343A

United States Patent [19]

Profé

[11] Patent Number: 5,649,343

[45] Date of Patent: Jul. 22, 1997

[54] METHOD FOR THE NEEDLING OF MATERIAL WEBS, APPARATUS SUITABLE THEREFOR AND USE OF SAME

[75] Inventor: Hans Jürgen Profé, Bobingen, Germany

[73] Assignee: Hoechst Aktiengesellschaft, Frankfurt am Main, Germany

[21] Appl. No.: 629,417

[22] Filed: Apr. 8, 1996

Related U.S. Application Data

[62] Division of Ser. No. 496,072, Jun. 28, 1995, Pat. No. 5,533,242.

[30] Foreign Application Priority Data

Jun. 30, 1994 [DE] Germany ..... 44 22 844.9

[51] Int. Cl.[6] ..... D06C 11/00; D04H 18/00

[52] U.S. Cl. ..... 26/33; 28/107

[58] Field of Search ..... 26/33

[56] References Cited

U.S. PATENT DOCUMENTS

| | | | |
|---|---|---|---|
| 720,018 | 2/1903 | Greene | 26/33 |
| 787,095 | 4/1905 | Greene | 26/33 |
| 810,273 | 1/1906 | Greene | 26/33 |
| 1,002,738 | 9/1911 | Mundorf | 26/33 X |
| 1,019,515 | 3/1912 | Mullers | 26/33 |
| 3,246,378 | 4/1966 | Beckers | 26/33 X |
| 3,369,435 | 2/1968 | Boultinghouse | 28/107 X |
| 3,372,447 | 3/1968 | Williams et al. | 28/113 |
| 3,526,349 | 9/1970 | Moro | 28/111 X |
| 3,909,891 | 10/1975 | Dilo | 28/111 X |
| 4,856,152 | 8/1989 | Kis | 28/114 |
| 4,897,901 | 2/1990 | Scholaert | 26/33 |
| 4,922,589 | 5/1990 | Busch | 26/33 X |

FOREIGN PATENT DOCUMENTS

| | | | |
|---|---|---|---|
| 429417 | 5/1926 | Germany | 26/33 |

*Primary Examiner*—John J. Calvert
*Attorney, Agent, or Firm*—John M. Genova

[57] ABSTRACT

An apparatus having a plurality of needle rollers (1) which are rotatable about their longitudinal axis (3) and the respective longitudinal axes (3) of which are themselves movable on a circular path. In this apparatus, the needle rollers (1) and support rollers (2) for the material web (9) alternate with one another.

6 Claims, 4 Drawing Sheets

METHOD FOR THE NEEDLING OF MATERIAL WEBS, APPARATUS SUITABLE THEREFOR AND USE OF SAME

This is a divisional of application Ser. No. 08/496,072, filed on Jun. 28, 1995, U.S. Pat. No. 5,533,242.

DESCRIPTION

The present invention relates to a method for the needling of material webs, such as sheets or bonded fabrics, and to an apparatus adapted for carrying out the method.

In the production and processing of bonded fabrics or of laminated materials, mechanical consolidating steps can be employed, needles, air jets or water jets conventionally being used. Examples of treatment steps of this type are the precompaction of bonded fabrics or the joining of a plurality of layers of bonded fabric to form a laminated material. Mechanical treatments of this kind are generally customary and are described, for example, in "Vliesstoffe" ["Bonded Fabrics"], the chapter "Vliesverfestigung" ["Fleece Consolidation"], page 122–129 (publisher: L ünenschloβ/Albrecht, Georg Thieme Verlag (1982)).

In addition to fleece consolidation, the use of needles has also become known in other steps in the processing of bonded fabrics.

Thus, German Utility Model 82-11,455 discloses a machine for the preconsolidation of a fleece, which is defined by the use of a transport device in the form of belts equipped with needles.

Furthermore, German Auslegungsschrift 2,160,209 discloses a method for the thermosetting of fleeces, in which the fleece to be treated is guided over a setting roller equipped with needles.

In these previously known methods and apparatuses, the needles therefore serve merely for the transport of material webs.

The use of a single rotating needle roller for the needling of material webs has already been described.

DE-A-2,530,872 describes a needling apparatus consisting of a single roller equipped with felt needles and of a support roller which is equipped with pressure-resistant, but laterally deflectable support elements. The two rollers run in opposition, and the textile material is needled by felt needles in the region of engagement of the rollers. When needle rollers are used, therefore, it is to be expected that the material web to be needled may be damaged under the drastic conditions of the needling. In these apparatuses, the needles projecting radially from the roller and rotating with the roller have different circumferential speeds between the needle butt and needle tip. The needle therefore usually acts differently, depending on the depth of penetration into the material web, when the needle is located in a material web moved at a constant speed.

DE-C-3,822,652 describes a needling apparatus, in which a single needle roller describes a hypocycloidal path, on the one hand about the axis of the needle roller and on the other hand about an axis of rotation parallel to the roller axis. With this apparatus, only a low needling density, that is to say too small a number of pricks per unit area, can be achieved.

In conventional needling, a needle bar moves up and down perpendicularly to the direction of movement of the substrate to be needled. At the same time, the needles go into and come out of the particular substrate and cause a perforation of the material web; this leads, as a result of barbs in the needles, to an interlacing of individual fibers. The maximum production speeds hitherto obtainable on conventional needling machines are approximately 40 m/min and are principally limited by the maximum obtainable frequency of the needle bar, the desired needling density and the longitudinal stretching caused in the fleece by the dwell time.

The object of the present invention is to provide a method for the needling of material webs, in which, with customary needling densities, considerably higher production speeds can be achieved in comparison with conventional needling methods.

The present invention relates to a method for the needling of a material web, wherein the material web is guided at a predetermined speed over a plurality of needle rollers rotating about their longitudinal axis and arranged transversely to the direction of movement of the material web, the material web in each case covering part of the surface of the needle rollers, and the circumferential speed of the needle rollers being set relative to the speed of the material web in such a way that the desired amount of needling, with adjustable longitudinal stretching, is obtained.

By "material web" is to be meant, within the meaning of the present description, those sheet-like structures which are varied in their structure as a result of the action of the needles of the needle roller; examples of these are sheets or, in particular, sheet-like textile structures, particularly bonded fabrics or combinations containing bonded fabrics and sheet-like structures to be joined to these to form laminated materials.

By "needling" is to be meant, within the meaning of the present description, a treatment of the above-mentioned material webs by the needles of the needle roller, the material webs being varied in their structure as a result of this treatment. Examples of needling steps are the perforation or slitting of sheets or of sheet-like textile structures and preferably the mechanical interlacing or joining of the fibers of sheet-like textile structures, such as, for example, of bonded fabrics or of laminated materials containing bonded fabrics. The needles can be smooth or be provided with barbs.

As already mentioned, at predetermined rotational speed of the needle roller the needles projecting radially from the roller have different speeds along their radial extension. A material web located in the region of engagement of the needle roller and moving at a predetermined speed therefore experiences, along its thickness, different deformations which originate from the relative speed between the needle and material web at this point.

Furthermore, the direction of movement of the material web changes during transport along a needle roller, with the result that the relative speed between a needle and the material web additionally changes. Consequently, during the transport of the material web along the needle roller, the forces acting on the material web at a specific location of the latter change.

The method according to the invention is based on the discovery of adjusting the forces generated in the material web as a result of the relative speed between the needle movement and the movement of this same material web, in such a way that the desired needling effect is achieved.

In a preferred embodiment of the method according to the invention, the rotational speed n of the needle rollers is selected in such a way that the circumferential speed $v_{needle}$ of the needles corresponds to the speed $v_{mat}$ of the material web at at least one point, located in the material web, in the region between the needle butt and needle tip and at a point in the region between needle entry and needle exit.

In particular preference, the rotational speed n of the needle rollers is selected in such a way that the circumferential speed $v_{needle}$ of the needles corresponds to the speed $v_{mat}$ of the material web at at least one point, located in the material web, in the region between the needle butt and needle tip and in the middle between the needle entry point and needle exit point.

In a further preferred embodiment of the method according to the invention, the rotational speed n of the needle roller, the speed $v_{mat}$ of the material web and the looping angle $\alpha$ of the material web around the needle roller are selected in such a way that there results, as a vectorial difference between the circumferential speed $v_{nape}$ of the needle tips and the speed of the material web $v_{mat}$ at the point of the pricking of the needle into the material web, a penetrating speed of the needle $v_{rele}$, the direction of which is perpendicular to the direction of movement of the material web at the point of the pricking of the needle into this material web.

The ratios during the exit of the needle out of the material web can, of course, be used in a similar way. In this case, the rotational speed n of the needle roller, the speed $v_{mat}$ of the material web and the looping angle $\alpha$ of the material web around the needle roller are selected in such a way that there results, as a vectorial difference between the circumferential speed $v_{nspa}$ of the needle tips and the speed of the material web $v_{mat}$ at the point of exit of the needle out of the material web, an exit speed of the needle $r_{rela}$, the direction of which is perpendicular to the direction of movement of the material web at the point of exit of the needle out of this material web.

In a further particularly preferred embodiment of the method according to the invention, a plurality of needle rollers rotating about their longitudinal axis and having a radius r are guided in a circle of the radius R.

The material web is preferably guided in such a way that it can come into contact with the needle rollers along approximately half the distance of the circular movement circumscribed by the needle rollers.

This type of guidance of the needle rollers in the form of a planetary movement can ensure in a simple way that the needle rollers roll on the material web; a kinematic compensation of the different rolling speeds between the needle butt and needle tip is thus possible.

The planetary movement of the needle rollers results in a series of design parameters which allow a favorable solution for longitudinal stretching, needle density and production speed. As a result of the opposed movement of the axes of the needle rollers in relation to the movement of the material web, it is possible, for example, to ensure that, in spite of a higher circumferential speed than the speed of the material web, the needle rollers behave synchronously with the movement of the material web during needle engagement.

By virtue of the rolling movement of a needle roller in relation to the material web, the needle engages into the material web at a different circumferential speed, depending on the depth of penetration. These circumferential speeds should, where possible, be adapted to the transport speed of the material web. If the differences between these two speeds are too large, this can lead to longitudinal stretching or even to damage of the material web. It is therefore preferably desirable that there should be a penetrating movement of the needle which, as far as possible, occurs perpendicularly to the direction of movement of the material web.

The method according to the invention affords the possibility, during a roller continuous needling operation, of setting the relative speed between the movement of the needle and the movement of the material web, independently of the depth of penetration of the needle into the material web, in such a way that the difference between the web-directed component of the movement of the needle and the speed of the material web is minimized toward zero.

In a particularly preferred embodiment of the method according to the invention, a plurality of needle rollers of radius r rotating about their longitudinal axes are guided in a circle of radius R, the direction of rotation of the needle rollers being opposite to the direction of rotation of the needle-roller axes, and the speed of the material web $v_{mat}$, the rotational speed n of the needle rollers of radius r and the orbiting rotational speed N of the needle-roller axes on the circular path of radius R being selected so that these correspond to the relation (I)

$$v_{mat}=2*\pi*r*n-2*\pi*(r+R)*N \quad \text{(I).}$$

The invention is illustrated in more detail in FIGS. 1 to 4.

Figure 4:
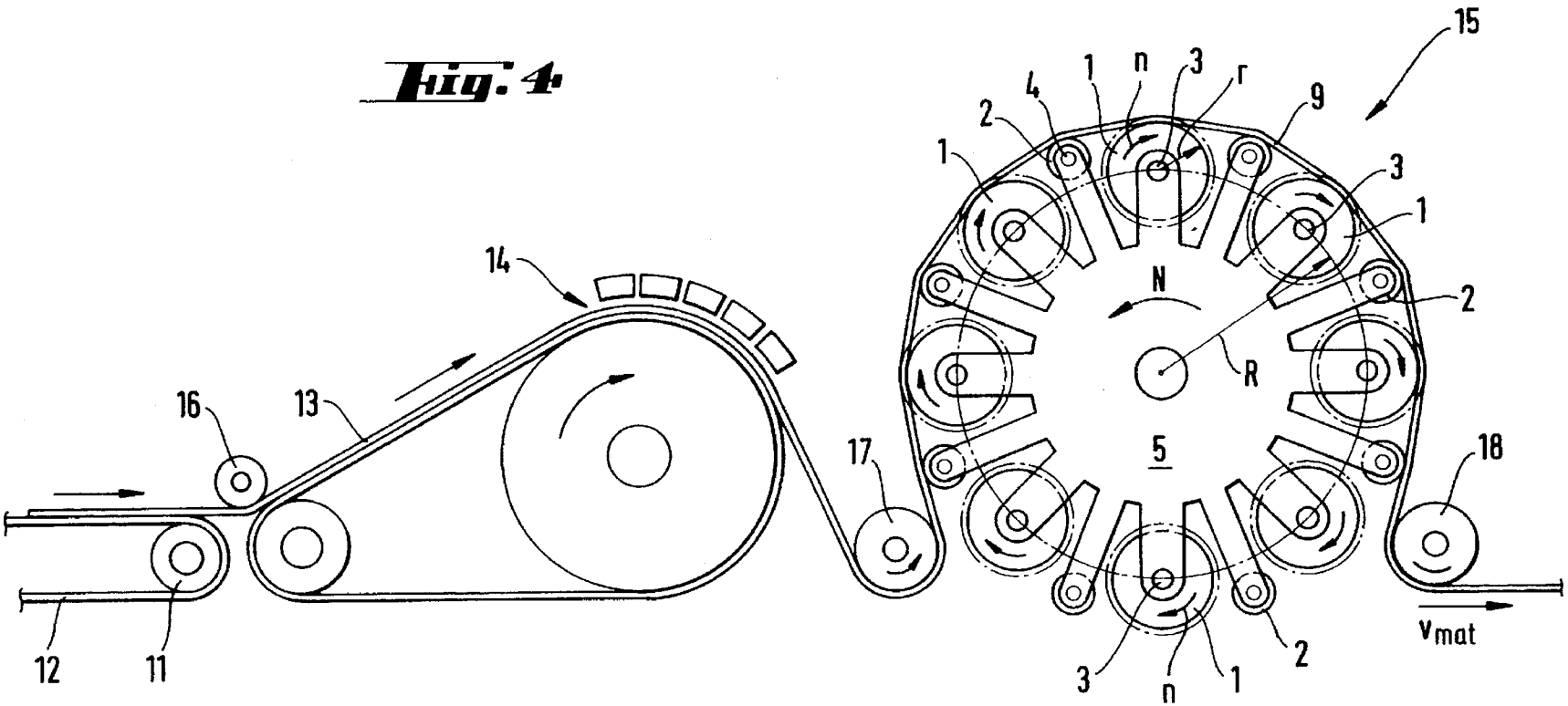

FIG. 4 finally illustrates the use of the apparatus according to the invention in the needling of preconsolidated bonded fabrics.

Figure 1:
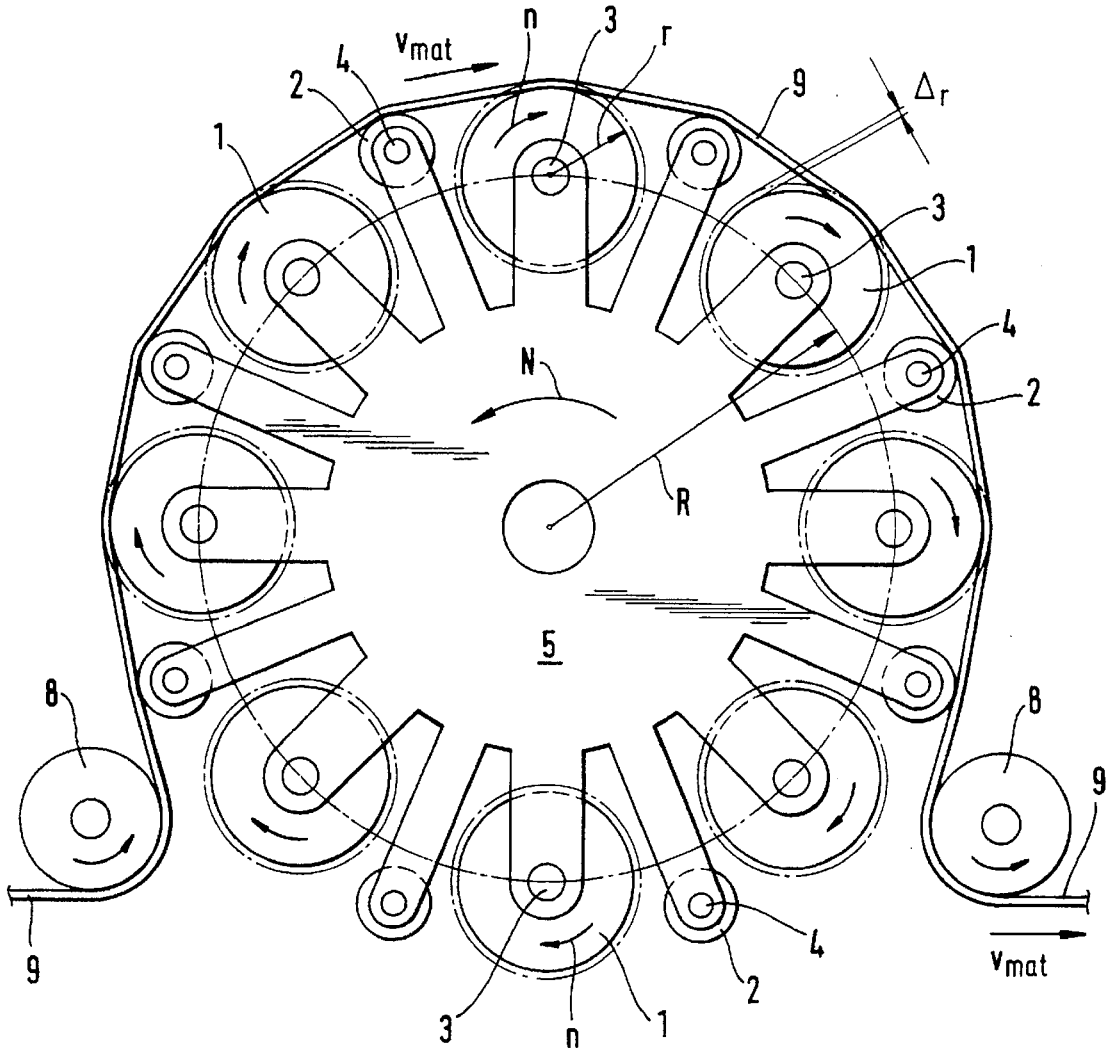
FIG. 1 illustrates in cross section an apparatus for carrying out the method according to the invention which is likewise a subject of the present invention.

The apparatus according to FIG. 1 comprises a plurality of needle rollers (1) of radius r, which are operated at the rotational speed n, and a plurality of support rollers (2). Needles of length $\Delta r$ project in the radial direction from each of the needle rollers. The needle rollers (1) and support rollers (2) in each case succeed one another alternately, are in each case rotatable about their longitudinal axes (3, 4) and are themselves arranged in a circle. The needle rollers are guided at the rotational speed N with the radius R. For this purpose, the needle rollers (1) and support rollers (2) are located on a carrier (5). The carrier (5) and needle rollers (1) are in each case moved by different drives (not shown). The needle rollers are preferably moved via a gearwheel drive. The material web (9) is guided at the speed $v_{mat}$ along part of the surface of the circular arrangement of the needle rollers and support rollers, deflecting rollers (8) preferably being present in each case at the positions before the material web (9) meets the apparatus according to the invention and after it has left the latter.

Figure 2:
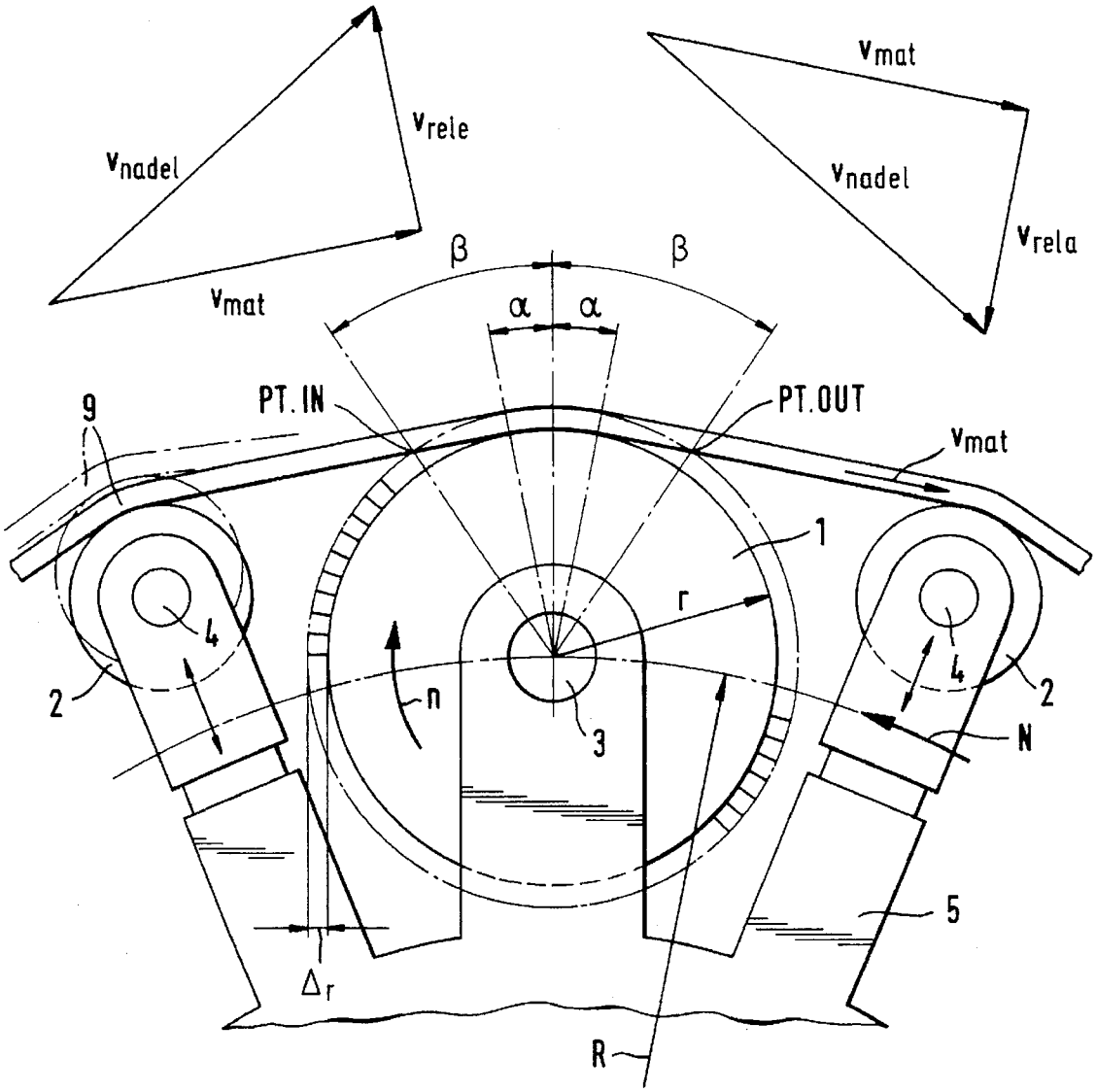
FIG. 2 shows further details of the apparatus according to FIG. 1.

FIG. 2 shows in detail the arrangement of a needle roller (1) and of a support roller (2) according to FIG. 1. Furthermore, the preferred speed ratios at the moments of entry of the needles into and exit of the needles out of the material web are shown in this figure. The needle roller (1) has a radius r and rotates at a rotational speed n. Needles (shown only partially) of length $\Delta r$ project radially from the needle roller (1). The material web (9) moves along the support roller (2) and the needle roller (1) at the speed $v_{mat}$. The looping angle $\alpha$ of the material web (9) around the needle roller (1) and the contact angle $\beta$ can be modified by varying the position of the support roller (2).

By the looping angle $2\alpha$ is to be meant that angle which the line between the center point of the needle roller (1) and the meeting point of the material web (9) with the needle roller (1) and the line between the center point of the needle roller (1) and the lift-off point of the material web (9) from the needle roller (1) form with one another.

By the contact angle $2\beta\alpha$is to be meant that angle which the line between the center point of the needle roller (1) and the meeting point of the material web (9) with the needle tips and the line between the center point of the needle roller (1) and the lift-off point of the material web (9) from the needle tips form with one another.

The axes of rotation (3) of the needle roller (1) moves, in turn, around a circle of radius R at the orbiting rotational speed N.

From the relation (I) shown further above $$v_{mat}=2*\pi*r*n-2*\pi*(r+R)*N \quad \text{(I)},$$

it is possible, for a predetermined speed of the material web $v_{mat}$ and the selected orbiting rotational speed N, to determine the preferred rotational speed of the needle roller n; this accordingly becomes $$n=(2*\pi*(R+r)*N+v_{mat})/2*\pi*r \quad \text{(II)}.$$

Different needling densities or longitudinal stretchings of the material webs can be achieved by a variation of various parameters.

These parameters include, for example, the radius R, the diameter and number of needle rollers, the looping angle $\alpha$ or contact angle $\beta$, the rotational speeds n and N.

In a particularly preferred embodiment, eight needle rollers are used, having the radius r of 200 mm and moving in a circle of radius R of 800 mm. This arrangement is shown in FIG. 2 for a looping angle $2\alpha$ of 22.5°.

At a speed of the material web of 100 m/min and an orbiting rotational speed N of 10 $min^{-1}$, this corresponds, according to the abovementioned relation (II), to a needle-roller rotational speed n of 129.6 $min^{-1}$.

The speed ratios resulting from this at the needle-in and needle-out points are to be seen from the vector diagrams likewise shown in FIG. 2. The relative speeds $v_{rele}$ and $v_{rela}$, formed from the speed of the needle tip $v_{needle}$ and the speed of the material web $v_{mat}$, are to be derived from the vector diagrams and, here, are 1030 mm/sec.

Since, in the illustrated version of the method according to the invention, $v_{rele}$ and $v_{rela}$ are arranged perpendicularly to the speed of the material web, this signifies no relative leading or trailing of the needle, that is to say no stretching, at the needle-in and needle-out point. With a maximum looping angle of 157.5° (three needle rollers and four support rollers in the looping region) of the material web along the circle circumscribed by the needle rollers, there are 5.83 rollings of a needle roller during engagement with the material web. This results, with a needle division of 10 mm, in a needling density of 3.74 mm in the longitudinal direction of the material web.

If longitudinal stretching is desired, this is possible in the instance described, for example by means of a slight change in the rotational speed n and/or N. However, this can also be achieved by changing the looping angle $\alpha$, for example by changing the radial position of the support rollers.

Figure 3A:
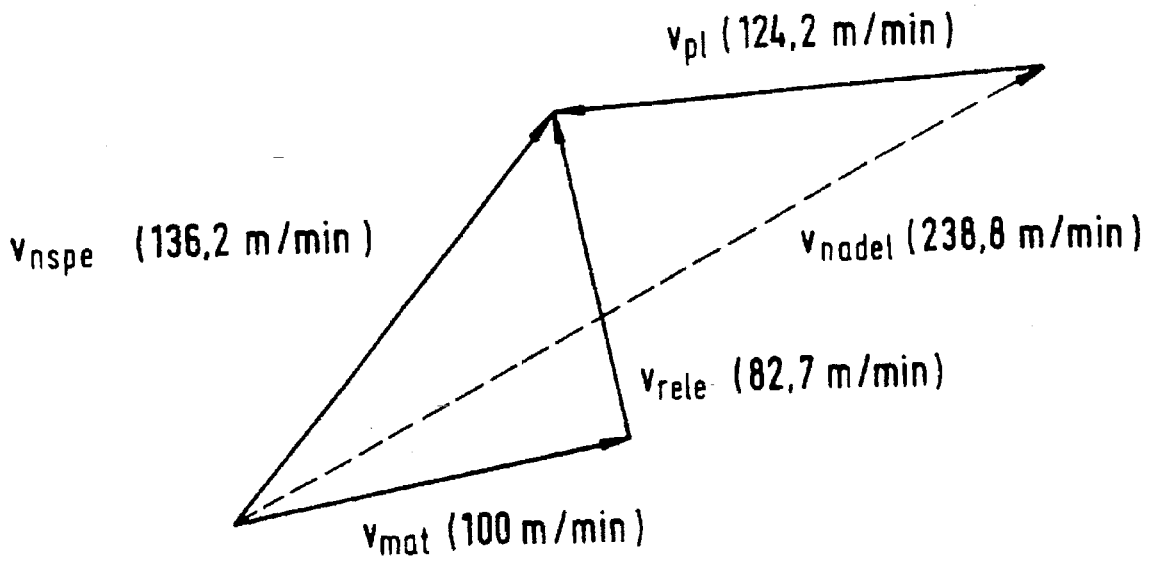
FIG. 3 shows the speed ratios during needling by means of the apparatus according to FIG. 1.
Figure 3B:
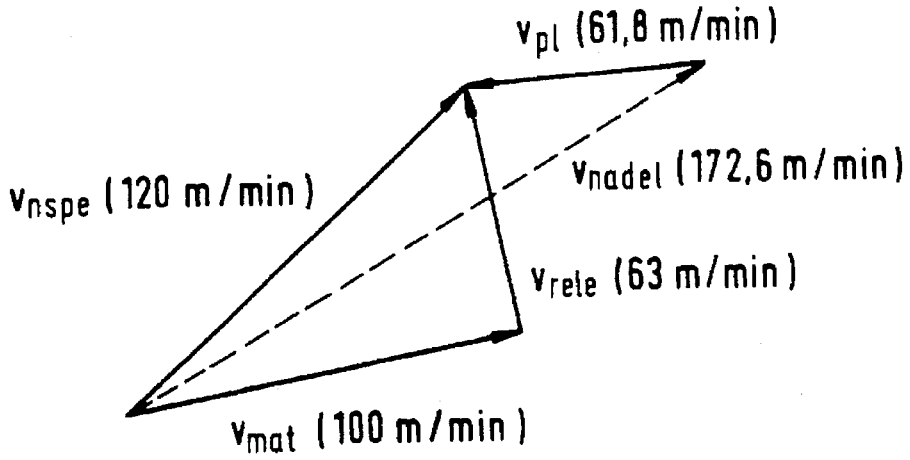

In FIG. 3 A/B, the vector diagram, contained in FIG. 2, at the location of the needle prick is shown in detail for two embodiments. It can be seen from this that the speed of the needle tip $v_{nspe}$ is itself a relative movement which is composed of the rotational movement of the needle rollers n at the circumferential speed $v_{needle}$ and of the orbiting rotational speed N of the needle-roller axis and the circumferential speed $v_{p1}$. FIG. 3 shows the speed ratios, in each case for the same speed of the material web $v_{mat}$ of 100 m/min and different speeds $v_{p1}$ and $v_{nspe}$. In the two versions shown, care was taken to ensure that the vectorial difference between the circumferential speed $v_{nspe}$ of the needle tips and the speed of the material web $v_{mat}$ at the point of the pricking of the needle into the material web results in a penetrating speed of the needle $v_{rele}$, the direction of which is perpendicular to the direction of movement of the material web at the point of the pricking of the needle into this material web. The upper vector diagram in FIG. 3 represents the speed ratios during needling, in which n=179.58 $min^{-1}$ and N=20 $min^{-1}$; the lower vector diagram in FIG. 3 represents the speed ratios during needling, in which n=129.577 $min^{-1}$ and N=10 $min^{-1}$.

FIG. 4 illustrates the needling of a preconsolidated bonded fabric by means of the apparatus according to the invention. A web of a non-preconsolidated bonded fabric (13) is fed by a conveyor band (12), running between rollers (11), of a fleece-production installation (not shown) to a preconsolidating device (14), for example a device in which preneedling takes place by means of water jets. A further needling of the material web (9) subsequently takes place in the apparatus (15) according to the invention. In, this, the material web (9) is guided in a semicircle along radially arranged and moved needle rollers (1) and support rollers (2) which themselves rotate about their axes and which move with their axes in the opposite direction of rotation. During the movement of the material web, the latter can, of course, be supported from outside by guide elements known per se, such as rotating bands, for the needling operation. The needled bonded fabric is subsequently fed to a dryer and a winder which are not shown. Deflecting rollers (16, 17, 18) are mounted in each case between the preconsolidating device (14) and the apparatus (15) according to the invention, the deflecting rollers (17) additionally also containing a water suck-off device.

In the embodiment illustrated, the apparatus according to the invention can be operated, for example, with the following setting:

Speed of the bonded fabric: 100 m/min

Radius R+r of the web of bonded fabric along the apparatus according to the invention: 1000 mm Orbiting rotational movement N: 20 $min^{-1}$ (corresponding to an external speed of 125.66 m/min)

Radius r of the needle rollers: 200 mm

Rotational speed of the needle rollers n: 179.58 $min^{-1}$ (corresponding to an external speed of 225.67 m/min)

Needle length: 12 mm (corresponding to an external speed of the needle tip of 239.21 m/min).

I claim:

1. An apparatus for the needling of a material web (9), comprising a plurality of needling rollers (1) which are rotatable about a longitudinal axis (3) thereof and each longitudinal axes (3) is movable on a circular path of radius R, wherein the needling rollers are fitted with rows of radially projecting needles for perforation the material web with which they come in contact and for interlacing the individual fibers of the perforated material web.

2. The apparatus as claimed in claim 1, wherein there are additionally a plurality of support rollers (2) which are rotatable about longitudinal axes (4) thereof and each longitudinal axes (4) is movable on a circular path, the needle rollers (1) and support rollers (2) succeeding one another alternately in each case.

3. The apparatus as claimed in claim 1, wherein the support rollers (2) are movable in the radial direction.

4. An apparatus for the needling of a material web (9) comprising a plurality of needling rollers (1) of radius r which are rotatable about a longitudinal axis thereof (3) and each longitudinal axis (3) is rotatable on a circular path of radius R, the direction of rotation of the needling rollers (1) being opposite to the direction of rotation of the longitudinal axes (3), wherein the apparatus guides the material web (9) over the needling rollers (1) which are arranged transversely to the direction of movement of the material web (9) and are fitted with radially projecting needles for perforating the material web (9) with which they come into contact and for interlacing the individual fibers of the perforated material web (9), the material web covers part of a surface portion of each of the needling rollers (1) (9), and the speed $v_{mat}$ of the material web (9), the rotational speed n of the needling rollers (1) of radius r and the orbiting rotational speed N of the longitudinal axes (3) on the circular path of radius R is set so that the relationship $$v_{mat}=2*\pi*r*n-2*\pi*(r+R)*N \quad (I)$$

is met.

5. The apparatus as claimed in claim 4, wherein there are additionally a plurality of support rollers (2) which are rotatable about longitudinal axes thereof (4) and each longitudinal axes (4) is on a circular path, the needle rollers (1) and support rollers (2) succeeding one another alternately in each case.

6. The apparatus as claimed in claim 4, wherein the support rollers (2) are movable in the radial direction.

* * * * *